US006752143B2

(12) United States Patent
Chiang

(10) Patent No.: US 6,752,143 B2
(45) Date of Patent: Jun. 22, 2004

(54) RANGE HOOD HOUSING

(76) Inventor: Pi-Tang Chiang, No. 172-10, Chung Cheng Rd., Shang Feng Vill., Tai Ya Hsian, Taichung Hsien (TW)

( * ) Notice: Subject to any disclaimer, the term of this patent is extended or adjusted under 35 U.S.C. 154(b) by 49 days.

(21) Appl. No.: 10/252,133

(22) Filed: Sep. 23, 2002

(65) Prior Publication Data

US 2004/0055591 A1 Mar. 25, 2004

(51) Int. Cl.[7] ..... F24C 15/20
(52) U.S. Cl. ..... 126/299 D; 126/299 R
(58) Field of Search ..... 126/299 R, 299 D; 454/67; 55/DIG. 36

(56) References Cited

U.S. PATENT DOCUMENTS 2,494,146 A * 1/1950 Spanos ..... 55/429
3,199,435 A * 8/1965 Jenson ..... 126/299 D
4,944,285 A * 7/1990 Glassman ..... 126/299 D
5,312,296 A * 5/1994 Aalto et al. ..... 126/299 R
5,992,412 A * 11/1999 Paulger ..... 126/299 R

FOREIGN PATENT DOCUMENTS

JP 06300338 A * 10/1994 ..... 126/299 D

* cited by examiner

*Primary Examiner*—Sara Clarke
(74) *Attorney, Agent, or Firm*—Browdy and Neimark, P.L.L.C.

(57) ABSTRACT

A range hood housing is constructed to include a top cover shell, a bottom cover plate fastened to said top cover shell, and an oil cup. The bottom cover plate is provided at a bottom side thereof with a downwardly protruded bottom protrusion such that a top recess opposite the bottom protrusion is correspondingly formed at a top side of the bottom cover plate. The top recess has a bottom portion, a sloping portion surrounding the bottom portion, a plurality of smoke inlets on the sloping portion, and at least one drip hole on the bottom portion. The oil cup is detachably mounted on the bottom side of the bottom cover plate corresponding in location to the drip hole.

9 Claims, 6 Drawing Sheets

RANGE HOOD HOUSING

BACKGROUND OF THE INVENTION

1. Field of the Invention

The present invention relates to a range hood and, more particularly, to a housing for range hood, which greatly improves the smoke suction efficiency of the range hood.

2. Description of the Related Art

A regular gas range generally comprises two burners (there are gas ranges having only one single burner). Further, regular range hoods commonly have two circular smoke inlets bilaterally disposed in the bottom side of the housing adapted to suck in smoke from the cooking pot or pan at the burners of the gas range by means of the operation of a motor fan. Because smoke from frying food does not rush directly upwardly in a straight course toward the smoke inlet of the range hood above, but disperses upwards toward the whole area of the bottom side of the housing of the range hood, thereby causing a part of the smoke to escape out of the range hood and to be sucked into the user's lungs.

SUMMARY OF THE INVENTION

The present invention has been accomplished to provide a housing for range hood, which eliminates the aforesaid problem. It is therefore the main object of the present invention to provide a housing for range hood, which greatly improves the smoke suction efficiency of the range hood.

To achieve this object of the present invention, the range hood housing comprises a top cover shell, a bottom cover plate fastened to said top cover shell, and an oil cup. The bottom cover plate is provided at a bottom side thereof with a downwardly protruded bottom protrusion such that a top recess opposite the bottom protrusion is correspondingly formed at a top side of the bottom cover plate. The top recess has a bottom portion, a sloping portion surrounding the bottom portion, a plurality of smoke inlets on the sloping portion, and at least one drip hole on the bottom portion. The oil cup is detachably mounted on the bottom side of the bottom cover plate corresponding in location to the drip hole.

In a preferred embodiment of the present invention, the bottom cover plate is fastened to the top cover shell through a packing frame interconnected therebetween. However, the bottom cover plate can be directly fastened to the top cover shell as shown in another preferred embodiment of the present invention.

In a preferred embodiment of the present invention shows that the top recess of the bottom cover plate is integrally formed on the top side of the bottom cover plate. However, as shown in another preferred embodiment of the present invention, the bottom cover plate is constructed to include a mounting plate and a recessed plate on which the top recess is formed.

DETAILED DESCRIPTION OF THE PREFERRED EMBODIMENTS

Figure 1:
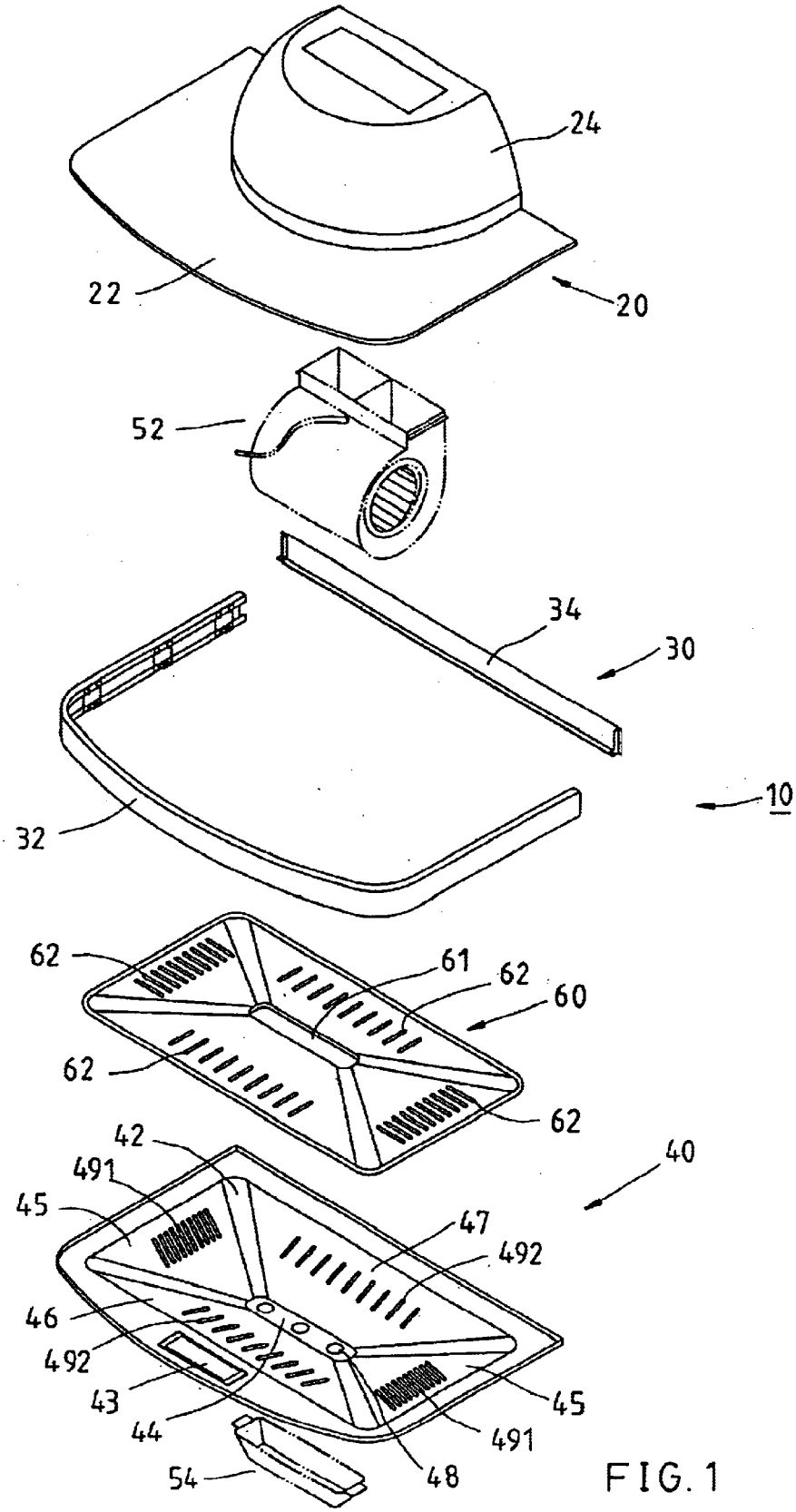
FIG. 1 is an exploded view of a first preferred embodiment of the present invention.
Figure 3:
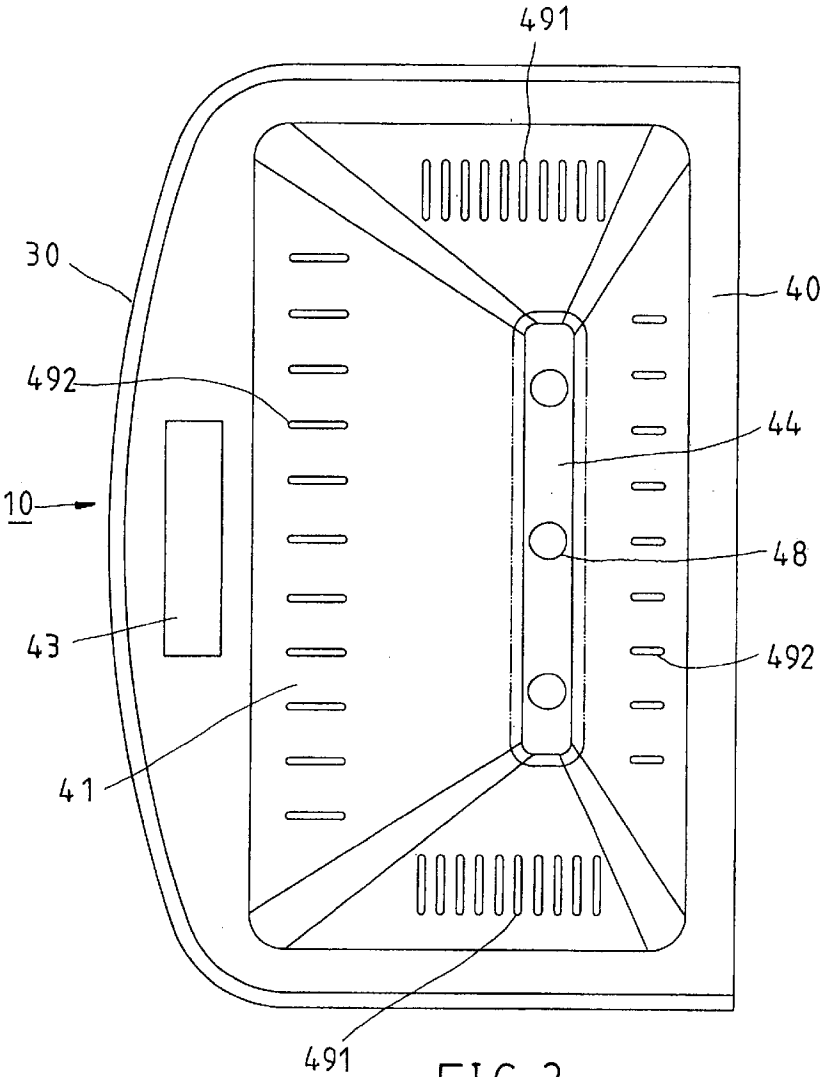
FIG. 3 is a bottom view of the first preferred embodiment of the present invention.
Figure 2:
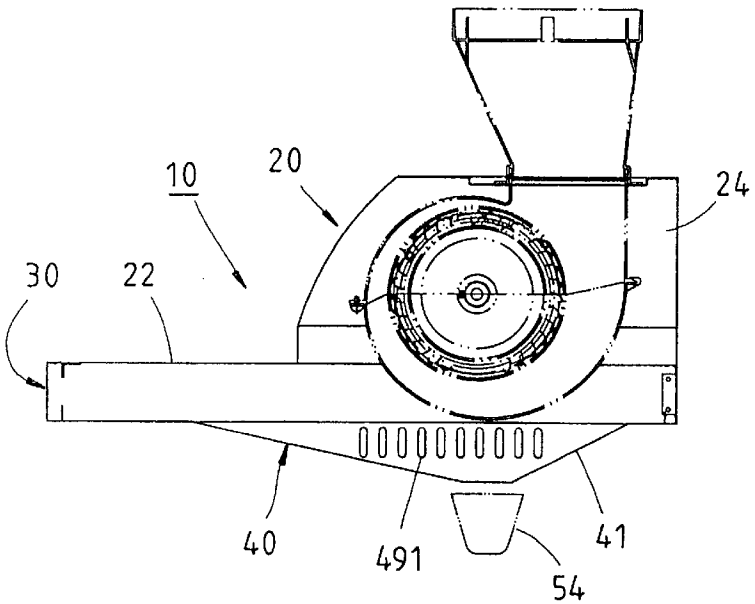
FIG. 2 is a side view of the first preferred embodiment of the present invention.

Referring to FIGS. 1~3, a range hood housing 10 in accordance with the first preferred embodiment of the present invention is shown comprising a top cover shell 20, the top cover shell 20 having a flat base 22 of substantially rectangular shape and a protruded portion 24 integral with a middle part of the flat base 22 at the rear side and defining a downward bottom open space, a packing frame 30 formed of a U-shaped packing strip 32 and a straight back packing strip 34 and fastened to the periphery of the flat base 22 of the top cover shell 20, and a bottom cover plate 40 fitting the profile of the flat base 22 of the top cover shell 20 and fastened to the packing frame 30. When assembled, the range hood housing 10 provides an inside space for the mounting of a motor fan 52, lamp means and etc. (this regard is not within the scope of the present invention, therefore no further detailed description in this regard is necessary).

The main features of the range hood 10 are outlined hereinafter. The bottom cover plate 40 is made of a metal plate by stamping, having a bottom side forming a downwardly protruded bottom protrusion 41 (see FIG. 2) such that a top surface of the bottom cover plate defines a top recess 42 corresponding to the opposite bottom protrusion 41. The top recess 42 is surrounded by a substantially rectangular periphery. The width of the substantially rectangular periphery of the bottom cover plate 40 at the front side is relatively greater than the width at the rear side and the other two opposite lateral sides so that sufficient area is provided at the front side for making a lamp hole 43. Alternatively, the lamp hole can be made at the rear side or either of the two opposite lateral sides of the substantially rectangular periphery of the bottom cover plate 40. The top recess 42 has a bottom portion 44 with an elongated flat surface and a sloping portion around the elongated flat bottom portion 44. The sloping portion include two triangular sloping surfaces 45 respectively disposed at the left and right sides, and two trapezoidal sloping surfaces 46 and 47 respectively disposed at the front and rear sides between the triangular sloping surfaces 45. The flat bottom portion 44 is equally spaced between the two opposite lateral side edges of the bottom cover plate 40, however it is relatively closer to the rear side edge of the bottom cover plate 40 rather than the front side edge (see FIG. 2). Therefore, the area of the front trapezoidal sloping surface 46 is greater than the rear trapezoidal sloping surface 47, and the sloping angle of the front trapezoidal sloping surface 46 is smaller than the rear trapezoidal sloping surface 47. The bottom cover plate 40 further comprises a plurality of drip holes 48 in the flat bottom portion 44, a plurality of main smoke inlets 491 and auxiliary smoke inlets 492 in the two triangular sloping surfaces 45, the front trapezoidal sloping surface 46 and the rear trapezoidal sloping surface 47. According to this embodiment, the smoke inlets 491 and 492 are elongated slots arranged in parallel. The smoke inlets 492 extend downwards along the sloping angle of the trapezoidal sloping surfaces 46, 47. The smoke inlets 492 extend obliquely downwards toward the left or right side along the sloping angle of the triangular sloping surface 45. Alternatively, the smoke inlets 491, 492 can be made having any of a variety of shapes.

A rectangular oil cup 54 is fastened to the bottom side of the downwardly protruded bottom protrusion 41 corresponding to the drip holes 48 the flat bottom portion 44, and adapted to collect accumulated waste oil from the drip holes 48.

In actual practice, the smoke inlets 491, 492 are formed in the bottom cover plate 40 by punching in direction from the bottom surface (bottom side) of the bottom cover plate 40 toward the top surface (top side) thereof. Therefore, when the smoke inlets 491, 492 made, the outer surface of the bottom cover plate 40 is maintained smooth, and the peripheral edges of the smoke inlets 491, 492 respectively protrude over the top surface of the bottom cover plate 40. In order to prevent injury of the worker or maintenance person's hands by the protruded peripheral edges of the smoke inlets 491, 492, a rectangular screen plate 60 is fastened to the bottom cover plate 40 and covered over the top recess 42. The rectangular screen plate 60 has a rectangular opening 61 corresponding to the flat bottom portion 44 of the bottom cover plate 40, and a plurality of slots 62 spaced around the rectangular opening 61 corresponding to the smoke inlets 491, 492 of the bottom cover plate 40. The opening 61 and slots 62 of the rectangular screen plate 60 are formed by punching in direction from the top surface of the rectangular screen plate 60 toward the bottom surface thereof. Therefore, the top surface of the rectangular screen plate 60 is maintained smooth when the opening 61 and the slots 62 made (the drip holes 48 of the bottom cover plate 40 are formed by punching in direction from the top surface of the bottom cover plate 40 toward the bottom surface thereof).

Figure 4:
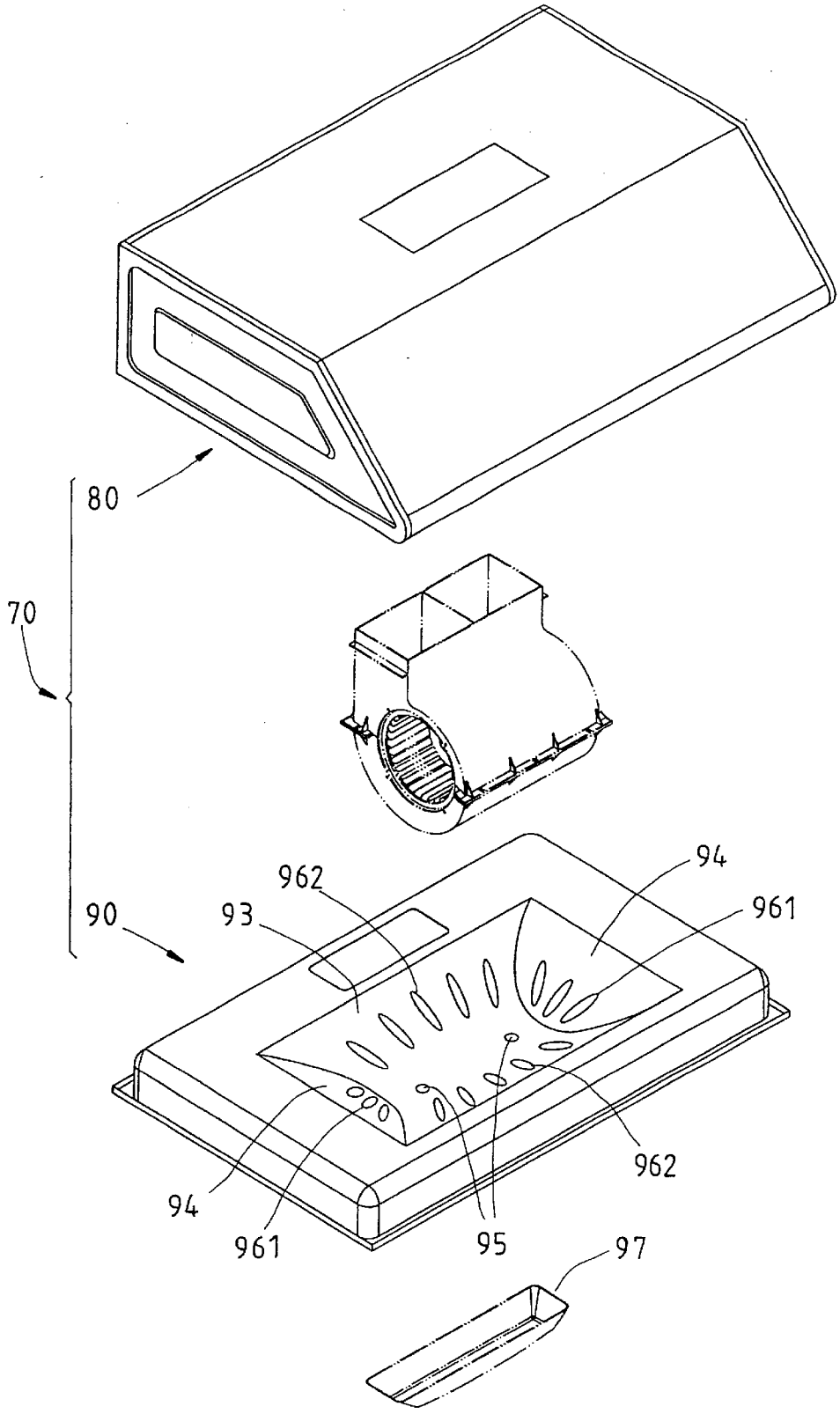
FIG. 4 is an exploded view of a second preferred embodiment of the present invention.
Figure 5:
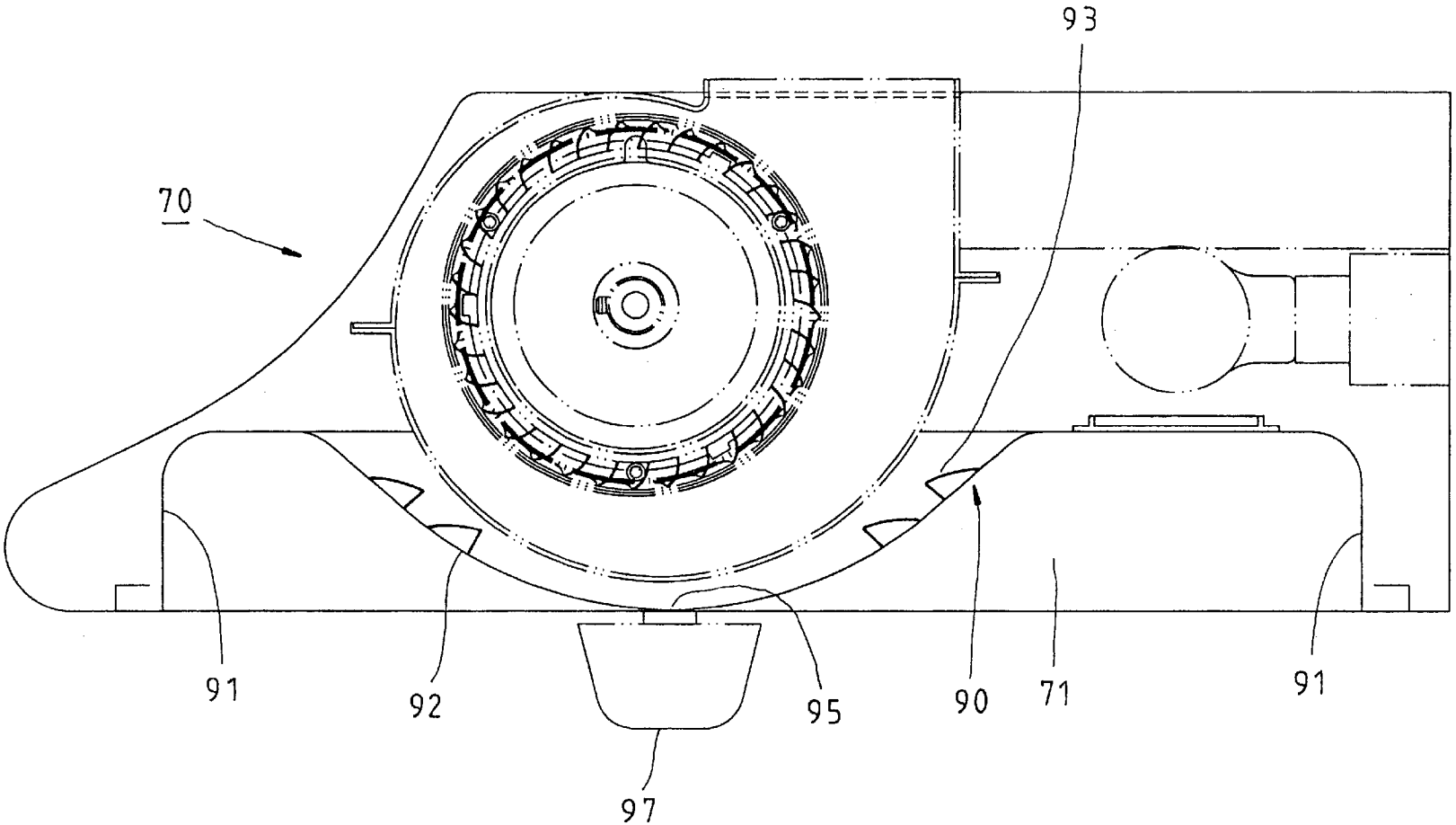
FIG. 5 is a side view of the second preferred embodiment of the present invention.

Because the smoke inlets 491, 492 extend in different directions in the four sides of the top recess 42, they form a big suction area covering almost the whole bottom side of the range hood. Therefore, smoke from the gas range can wholly be sucked into the range hood 10 and expelled to the outside of the house, i.e., the range hood eliminates the drawback of limited suction area of the conventional range hoods FIGS. 4 and 5 show a range hood housing constructed according to the second preferred embodiment of the present invention. According to this embodiment, the range hood housing 70 is comprised of a top cover shell 80 and a bottom cover plate 90. The top cover shell 80 defines a rectangular bottom opening. The profile of bottom cover plate 90 fits the bottom opening of the hollow top cover shell 80. The border area of the bottom cover plate 90 is bent downwards, forming a peripheral flange 91, which is fastened to the border of the rectangular bottom opening of the hollow top cover shell 80 such that a bottom recess 71 is defined around the downwardly protruded bottom protrusion 92 at the bottom side of the bottom cover plate 90. The lowest edge of the downwardly protruded bottom protrusion 92 is disposed at about the elevation of the bottom open side of the rectangular bottom recess 71. The topside of the bottom cover plate 90 forms a top recess 93 corresponding to the downwardly protruded bottom protrusion 92. The border of the top recess 93 has a substantially rectangular profile. The top recess 93 has a bottom portion and a sloping portion including two sloping surfaces 94 of substantially semi-circular profile respectively disposed at left and right sides. The front and rear sides of the peripheral wall of the sloping portion of the top recess 93 are smoothly downwardly curved inward and met at the lowest area between the sloping surfaces 94 of substantially semi-circular profile. The bottom cover plate 90 further comprises two drip holes 95 bilaterally disposed in the bottom portion of the top recess 93 between the sloping surfaces 94 of substantially semi-circular profile, and a plurality of oblong smoke inlets 961, 962 in the sloping portion of the top recess 93 around the drip holes 95 and spaced from the drip holes 95 at a distance and respectively extended toward the border area of the bottom cover plate 90. Further, a rectangular oil cup 97 is fastened to the bottom side of the bottom cover plate 90, and adapted to collect accumulated waste oil from the drip holes 95.

Figure 6:
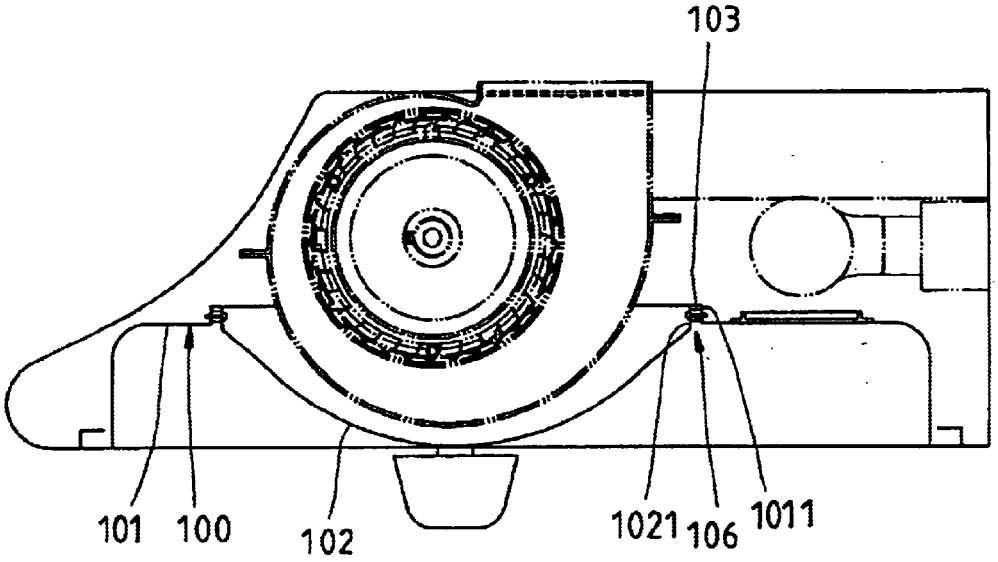
FIG. 6 is a side view of the third preferred embodiment of the present invention.

FIG. 6 shows a range hood housing constructed according to the third embodiment of the present invention. This embodiment is similar to the embodiment shown in FIGS. 4 and 5 with the exception of the structure of the bottom cover plate. According to this embodiment, the bottom cover plate 100 is comprised of a mounting frame 101, and a recessed plate 102 on which the top recess is formed. The recessed plate 102 has a vertical mounting flange 1021 fastened to a vertical mounting flange 1011 of the mounting frame 101 by long screw bolts 103, leaving a space 106 between the mounting frame 101 and the recessed plate 102 for enabling smoke to pass from the cooking pot or pan at the gas range into the inside of the gas range hood.

Figure 7:
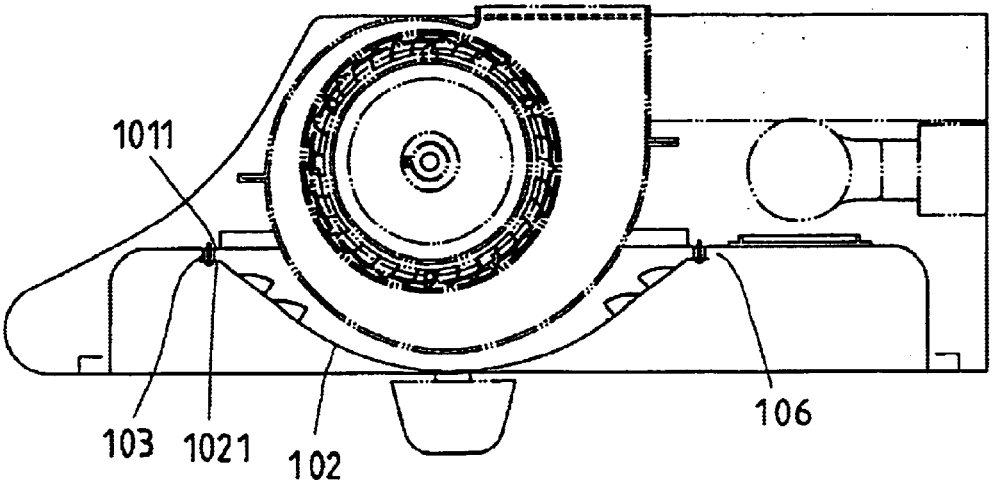
FIG. 7 is a side view of the fourth preferred embodiment of the present invention.

FIG. 7 shows a range hood housing constructed according to the fourth preferred embodiment of the present invention. This embodiment is similar to the embodiment shown in FIG. 6 with the exception of the design of the recessed plate 102. According to this embodiment, the recessed plate 102 has a horizontal mounting flange 1021 fastened to a horizontal mounting flange 1011 of the mounting frame 101 by long screw bolts 103, leaving a space 106 between the mounting frame 101 and the recessed plate 102 for enabling smoke to pass from the cooking pot or pan at the gas range into the inside of the range hood.

Figure 8:
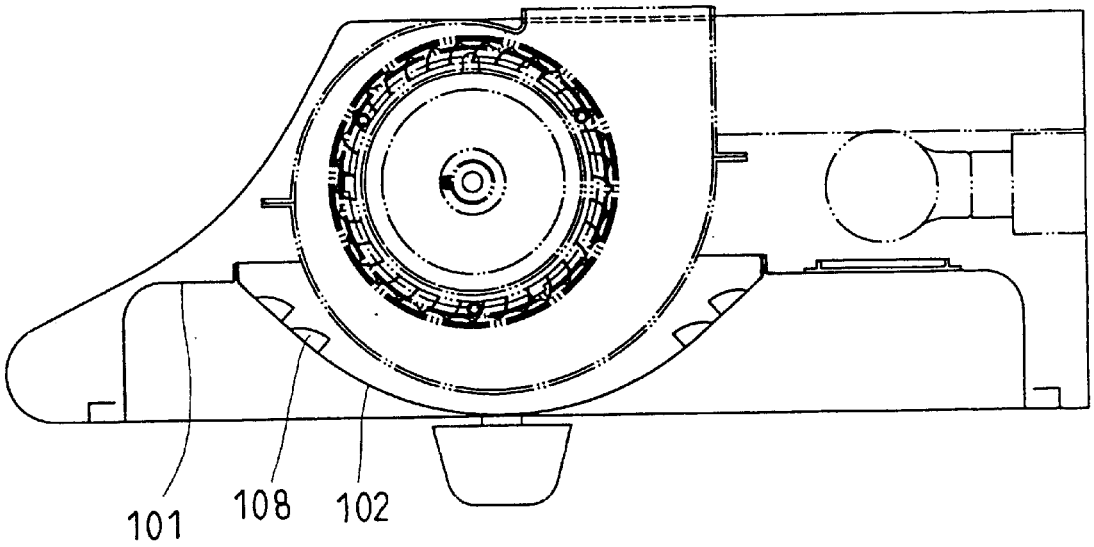
FIG. 8 is a side view of the fifth preferred embodiment of the present invention.

FIG. 8 shows a range hood housing constructed according to the fifth preferred embodiment of the present invention. This embodiment is similar to the embodiments shown in FIGS. 6 and 7 with the exception that the recessed plate 102 of this embodiment is fixedly abutted against the mounting frame 101 and, the recessed plate 102 has smoke inlets 108 for guiding smoke from the cooking pot or pan at the gas range into the range hood.

What the invention claimed is:

1. A range hood housing comprising:

a top cover shell;

a bottom cover plate fastened to said top cover shell, said bottom cover plate being provided at a bottom side thereof with a downwardly protruded bottom protrusion such that a top recess opposite the bottom protrusion is correspondingly formed at a top side of the bottom cover plate, said top recess having a bottom portion, a sloping portion surrounding the bottom portion, a plurality of smoke inlets on the sloping portion, and at least one drip hole on the bottom portion; and an oil cup detachably mounted on the bottom side of the bottom cover plate corresponding in location to the drip hole.

2. The range hood housing of claim 1, wherein the top recess is integrally formed on the top side of said bottom cover plate.

3. The range hood housing of claim 1, wherein said bottom cover plate comprises a mounting frame and a recessed plate detachably connected to said mounting frame and having the top recess.

4. The range hood housing of claim 1 further comprising a packing frame interconnected with said top cover shell and said bottom cover shell such that the bottom cover plate is fastened to the top cover shell through said packing frame.

5. The range hood housing of claim 1, wherein said top cover shell has a bottom opening and said bottom cover plate has a downward peripheral flange fitted to the bottom opening of said top cover shell and defining at the bottom side of the bottom cover plate a bottom recess around the bottom protrusion.

6. The range hood housing as defined in claim 1, claim 4 or claim 5, wherein the bottom portion of the top recess of said bottom cover plate is an elongated flat surface and the sloping portion of the top recess of said bottom cover plate includes two triangular sloping surfaces respectively disposed at left and right sides thereof, and two trapezoidal sloping surfaces respectively disposed at front and rear sides thereof.

7. The range hood housing as defined in claim 1, claim 4 or claim 5, wherein the sloping portion of the top recess of said bottom cover plate includes two sloping surfaces of substantially semi-circular profile respectively disposed at left and right sides thereof, a front peripheral wall and a rear peripheral wall smoothly connected between said sloping surfaces of substantially semi-circular profile.

8. The range hood housing as defined in claim 1, wherein said smoke inlets includes a plurality of main smoke inlets and auxiliary smoke inlets disposed around the bottom portion of the top recess of said bottom cover plate.

9. The range hood housing as defined in claim 1 further comprising a screen plate fastened to said bottom cover plate and covered over said top recess, said screen plate having at least one opening corresponding to the bottom portion of said top recess of said bottom cover plate and a plurality of slots spaced around the opening of said screen plate.

* * * * *